US006943762B2

(12) United States Patent
Leja

(10) Patent No.: US 6,943,762 B2
(45) Date of Patent: Sep. 13, 2005

(54) VISUAL MESSAGE DISPLAY DEVICE

(75) Inventor: Frank Leja, Belchertown, MA (US)

(73) Assignee: Newscanner, PLC, London (GB)

( * ) Notice: Subject to any disclaimer, the term of this patent is extended or adjusted under 35 U.S.C. 154(b) by 0 days.

(21) Appl. No.: 10/254,827

(22) Filed: Sep. 25, 2002

(65) Prior Publication Data

US 2003/0038762 A1 Feb. 27, 2003

Related U.S. Application Data

(63) Continuation-in-part of application No. 09/784,371, filed on Feb. 15, 2001, now Pat. No. 6,816,137.

(51) Int. Cl.[7] ..... G09G 3/32

(52) U.S. Cl. ..... 345/82; 345/1.2; 345/2.1; 709/224; 340/815.45

(58) Field of Search ..... 345/82–83, 85, 345/90, 91, 99, 110–111, 304, 207, 211, 214, 204; 340/815.5, 815.45, 815.53, 815.68; 709/220, 229, 223–227, 238, 239, 245–246, 230, 249

(56) References Cited

U.S. PATENT DOCUMENTS 5,210,603 A * 5/1993 Sabin ..... 348/157
5,796,376 A 8/1998 Banks

FOREIGN PATENT DOCUMENTS

| | | | |
|---|---|---|---|
| DE | 296 11 155.4 | 6/1996 | |
| DE | 296 21 296.2 | 12/1996 | |
| DE | 197 02 751.2 | 1/1997 | |
| DE | 297 04 397.2 | 1/1997 | |
| WO | 90/12354 | 10/1990 | |
| WO | 97/50070 | 6/1997 | |
| WO | 98/33164 | 1/1998 | |
| WO | WO 98/33164 | * 7/1998 | ..... G09G/3/00 |

OTHER PUBLICATIONS

LUMINO Elektronische Informationssyteme, *Magicball® User Manual*, 1997.

* cited by examiner

*Primary Examiner*—Bipin Shalwala
*Assistant Examiner*—Mansour M. Said
(74) *Attorney, Agent, or Firm*—Davis & Bujold, P.L.L.C.

(57) ABSTRACT

An alphanumeric and graphic symbol display device in which an LED array is rotated and controlled to project a display onto a translucent surface. The electrical power for the array is provided by way of a rotating contactless transformer independently of the control data for the array which is provided by infrared data transmission through a tubular shaft driven by a DC brushless, three-phase motor to rotate the array at a predetermined rate independent of the electrical power for the array and the control data.

7 Claims, 6 Drawing Sheets

VISUAL MESSAGE DISPLAY DEVICE

This is a continuation-in-part of a application Ser. No. 09/784,371 filed Feb. 15, 2001 and entitled "A Visual Message Display Device" now U.S. Pat. No. 6,816,137.

FIELD OF THE INVENTION

The present invention relates to a remotely controlled alphanumeric and graphic symbol display device incorporating a vertical array of light emitting diodes (LEDs) and digital imaging techniques to display messages, information, advertisements, news etc. The alphanumeric and graphic symbol display is manifested as an illuminated visual display on a stationary screen by the light emitted from the array of LEDs when electrically charged while the arm rotating at a desired speed. These display device may be located and controlled as a single unit or as a group of display devices in a local area network. Also the area immediately surrounding the display may be monitored by cameras or video scanners incorporated into the display device for security purposes.

BACKGROUND OF THE INVENTION

The readily accessible display of news and information, particularly in view of the rapidly changing and increasing speed of modern telecommunications, is becoming increasingly critical for use in commercial enterprises, leisure businesses and to the community at large. Display's of the type typically known in the industry are currently advantageously provided by electronic display signs, e.g. the "Traveling Word" screen display devices applying conventional LED matrix architecture, for instance LED's arranged in rows and columns in a matrix configuration, for use in stock exchanges or for public messaging and advertisements were invented, developed and installed in the early 1980s. These screens provided ready access to fiscal information that, by its very nature is constantly and rapidly changing.

The use of LEDs as light sources in patterns of rows and columns for displaying information is well known. Various features are comprehensively described in U.S. Pat. No. 5,796,362 issued to Banks. In that patent are disclosed large modular, electronic display sources comprising a sign controller, sign systems buses for data transmission, display panels, and panel control cards associated with each panel. This display sign supports for example 512 LEDs.

A static display unit is also disclosed in international patent application WO 90/12354 to Stella Communications Limited which is described as mounted on a motor driven, rotary unit. The unit provides cylindrical display from LEDs arranged in vertical columns which sweep around a cylindrical surface. The rotating unit carries a unit for controlling the LEDs and a memory.

Both international application filed by Lumino Licht Electronik GmbH, ("Lumino") numbers WO 97/50070 published on Dec. 31, 1997 and WO 98/33164 published on Jul. 30, 1998, relate to rotational display devices within a housing. WO 97/50070 describes a device for displaying alphanumeric characters and/or symbols, within a rotationally symmetric housing (19) of a transparent and/or translucent material; the housing (19) contains an electric motor (2) with a motor shaft (20) which revolves around a symmetrical axis (21); a carrier (5) which is rotationally fixed to the motor shaft (20) and on which is attached at least one row of light-emitting diodes or groups of light-emitting diodes (6) that are substantially perpendicular to the motor shaft (20); and a circuit board (4) with a control circuit for the light-emitting diodes (6). To improve control of the display device and the LED's and to provide for a technically simple series production, the display device also has an opto-electronic measuring device (15) made of a transmitter (22) and receiver (23), to measure the rotating speed of the carrier (5) for synchronizing control of the light-emitting diodes (6) with the rotating speed of the carrier (5), the transmitter and receiver are fixed to a rotating structural part of the device on the one hand and to a stationary structural part of the device on the other hand, at a short distance apart. With the use of software the signal picked up by the receiver can be converted into a clear square-wave signal, free from external interference so that the LED-control can be synchronized with the exactly or almost exactly measured rotating speed of the carrier (5). The device according to the invention also contains a mechanical balancing element (6, 8) opposite the carrier (5) in relation to the symmetrical axis (21), wherein the balancing element (7, 8) is a rod (7) of any cross-section, the operating length of which can be shortened, the rod being raised into a substantially horizontal position during operating.

WO 98/33164 relate to a spherical display device with a circuit board (4), accommodated inside a spherical housing (31), with drive and control elements and electronic components, as well as a support (5) rotating inside the housing (31) for light-emitting diodes or light-emitting diode groups (6). Transmission of electric energy onto the circuit board (4) is conducted by contactless inductive energy transmission. It is a critical feature of both WO 97/50070 and WO 98/33164 that contactless inductive transmission of electrical energy and/or data is provided to the circuit board and its circuits. It is also a critical feature to interface the device with programming means to control to the LEDs synchronously with the rotating speed of the carrier which, preferably, is rotated by a synchronous motor.

A disadvantage of the prior art proposals is the use of an induction motor having windings on its rotor connected to a power supply by slip rings or brushes which are disconnected to reduce wear with the slip rings being short circuited so that the rotor functions essentially as a squirrel cage motor (a slip ring induction motor). This type of motor is susceptible to wear and production of electrical noise potentially interfering with data controlling the LED display.

SUMMARY OF THE INVENTION

It is an object of the invention to provide a rotating information display system having an architecture that is capable of rapidly receiving and consistently displaying and disseminating any relayed data or information.

It is another object of the invention to provide a display device that is, reliable and easily transportable from one location to another. In particular, the display system has advantages of reliability, cost saving and space-saving, i.e. it can be desk-top size or ceiling or the more usual wall-mount.

It is a still further object of the present invention to provide a device that makes an infinite range of displayed information accessible at reasonable cost to businesses, particularly small businesses and the community-at-large.

Another object of the present invention is to provide a device of the kind set forth in the opening part of this specification, which, in a technically simple and in a wear-free manner, provides reliable energy and data transmission to the circuit board and rotating display elements and display circuits.

Another object of the present invention is to connect a plurality of the display devices in a local area network or other similar communication network to provide effective monitoring and control of a single or plurality of display devices.

A still further object of the present invention is to provide the display devices with a visual monitoring equipment for instance cameras, video scanners to monitor the environment surrounding the display device for security or safety purposes.

To achieve this end, the display device is such, that the electronic motor control for rotating the LED's, the electronic data transmission control and the circuit board power supply are kept entirely separate, independent and mutually exclusive. This separation is necessary in order that a smooth transmission of data is provided to the circuit board which controls the LED's. Thus the data flow and transmission to the circuit board and thus the display of the desired information will not be interrupted or interfered with as they would in a device which must simultaneously control the functions and operations of the motor and data transmission.

To this end, the motor is a DC brushless, three-phase motor operated by a series of pulses to accurately control rotational speed. This DC brushless, three-phase motor provides appropriate rotation of the LED's, operates on a completely separate control circuit, than that used to control the data transmission flow and the inductive energy transmission used as a contactless energy transmission to the circuit board.

According to one aspect of the invention provides a display device for visually displaying illuminated graphic and alphanumeric symbols on a screen, the display device comprising: a tubular drive shaft defining an axis of rotation; a housing substantially encompassing a motor for driving the hollow drive shaft; a PCB supported at one end of the tubular shaft for rotation therewith; an array of light emitting diodes mounted to the PCB for rotation therewith; a central processing unit positioned on the circuit board for controlling an actuation sequence of the light emitting diodes; a contactless rotary transformer for supplying electrical power to the circuit board, central processing unit and light emitting diodes; and an optical receiver positioned on the circuit board for directly receiving display control data for the central processing unit from a remote source through the tubular shaft from an optical transmitter.

According to another aspect of the invention provides a moving display device comprising: a) a vertically oriented LED array for projecting a moving display onto a translucent surface; b) a shaft for rotating the LED array about a longitudinal axis of the shaft, the shaft being tubular; c) an infrared data receiver for receiving control data, for the LED array to produce the moving display, through the tubular shaft along said axis from an infrared data transmitter; d) a CPU to control the LED array in response to the received control data; e) a data entry unit to operate the infrared data transmitter to transmit the control data through the tubular shaft for receipt of the infrared data receiver; f) the rotary contactless transformer for inductively providing power to operate the CPU and LED array; and g) a DC brushless, three-phase electric motor connected to rotate the shaft about said axis of a predetermined rate independent of the control data transmission and CPU and LED array power supply.

According to another aspect of the invention provides a moving display device comprising: a) a vertically oriented LED array for projecting a moving display onto a translucent surface; b) a shaft for rotating the LED array about a longitudinal axis of the shaft, the shaft being tubular; c) an infrared data receiver for receiving control data, for the LED array to produce the moving display, through the tubular shaft along said axis from an infrared data transmitter; d) a rotary contactless transformer for inductively providing power to operate the LED array; and e) a DC brushless, three-phase electric motor connected to rotate the shaft about said axis of a predetermined rate; wherein the power supply for the motor, the control data transmission and the LED array power supply are independent of one another.

BRIEF DESCRIPTION OF THE DRAWINGS

The invention will now be described, by way of example, with reference to the accompanying drawings in which.

DETAILED DESCRIPTION OF THE PREFERRED EMBODIMENTS

Figure 1:
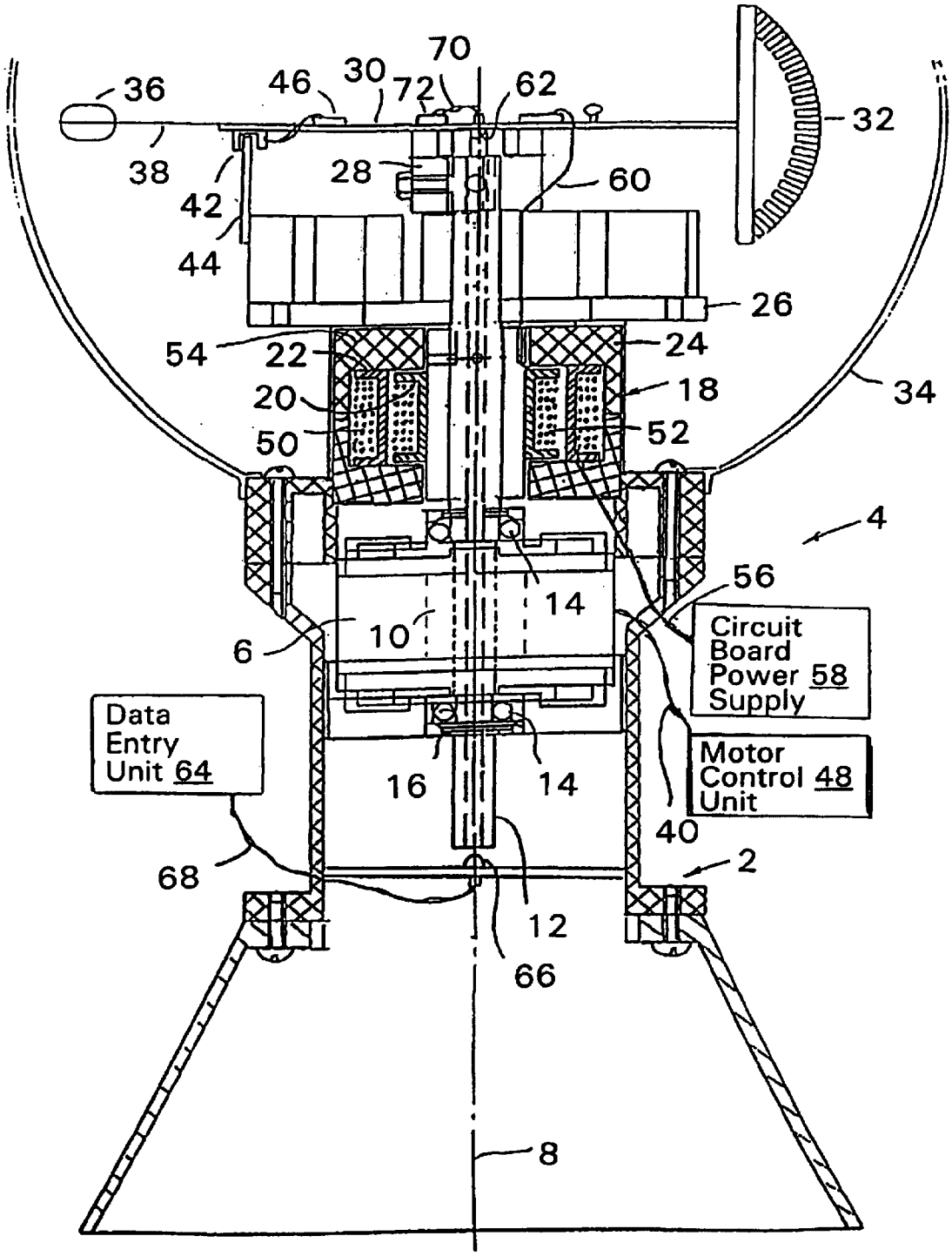
FIG. 1 which is a diagrammatic partially sectioned illustration of a display device according to the present invention.

With reference to FIG. 1, a vertically oriented, support structure 2 of the display device 4 supports a motor 6, defining a vertical axis 8 of symmetry and rotation for the device 4, having a rotor 10 connected to rotate a vertical tubular shaft 12 about axis 8. The rotor 10 and shaft 12 are supported for rotation, by the motor 6, by spaced ball bearings 14 the lower of which is associated with a thrust bearing 16 to axially support the shaft 12.

Above the motor 6, the structure 2 supports a rotary transformer 18 having an inner bobbin 20 attached to the shaft 12 for rotation therewith and an outer bobbin 22 supported by a stationary transformer housing 24 which is connected to a stationary heat sink 26 for the transformer 18.

The shaft 12 extends through the heat sink 26 to a connector 28 on which a printed circuit board (PCB) 30 is mounted for rotation with the shaft 12. The PCB supports a single vertically oriented arcuate array 32 of LEDs (a plurality of arrays could be used) and control circuit components CPU ROT_processor (CPU) to provide a desired alphanumeric-graphic display, responsive to data input, and visually displayed as a rotating display visible to an observer on a spherical translucent globe 34 which is supported on structure 2 and centered on the axis 8 and the plane of the PCB 30.

Although described as a globe in this exemplary detailed description, it will be appreciated that the spherical translucent globe 34 could be a translucent cylindrical surface or other translucent surface.

The PCB 30 also supports a balance weight 36 by way of a leaf spring 38.

The motor 6 is a DC brushless, three-phase electric motor. This DC brushless, three-phase electric motor turns the drive shaft 12 and drives the circuit board platform upon which rests the LEDs. The DC brushless, three-phase motor 6 is connected to the local supply voltage by way of a standard supply cable 40 through an entrance in the support structure 2, the motor being supplied with all power necessary for the display device to function in accordance with the invention herein described. The body of the DC brushless, three-phase motor 6 is wound to match the required operating voltage.

The minimum optical speed of a single row of LEDs in order to make the message look smooth has been found to be 1750 rpm: at 1200 rpm a light flicker is seen, while 3000 rpm is too fast, and at the same time generates more power requirements than are needed. The optimum revolutions per minute of the DC brushless, three-phase motor 6 is somewhere between 1500 rpm and 1800 rpm. This has been achieved without the necessity of designing elaborate controls for the DC brushless, three-phase motor 6. In the preferred embodiment, the optimum speed is 1700 rpm. A "tick indicator" 42 signals to the circuit board where it is in the 360 degree cycle of every revolution. This device indicates where zero is in each rotational cycle, of the printed circuit board and determines a fixed point on which the LED indicator cycle breaks.

The tick indicator 42 is located on the PCB 30 with a stationary tick producing bar 44 attached to the heat sink 26. This indicator 42 is an optical sensor, activated by the bar located on the heat sink 26 which breaks a light beam thereby indicating, to the processing device that the rotating arm has traveled 360 degrees since the preceding tick. The microprocessor CPU ROT_processor on the PCB 30 is independent of motor speed torque or any voltage variations, The software is designed to position the DC brushless, three-phase motor 6 precisely at any given point during very revolution, so that once the microprocessor CPU ROT_ processor receives the intended signal, the software will refresh or upgrade existing data to later data in its memory and check the internal software to insure nothing has corrupted the data. In this way, the software, in the manner of its design, maintains stability throughout the display system. At the point of manufacture, the DC brushless, three-phase motor 6 is fixed at 2450 rpm.

It has been found that with particular advantage, the DC brushless, three-phase motor 6 is operated with pulse-width modulated signals generated by a motor control unit by a microprocessor 48. These signals are sent to the DC brushless, three-phase motor 6 through electronic circuits on a high frequency pulse averaging 25 to 30 microseconds in length. Each pulse will drive a phase of the DC brushless, three-phase motor 6. For a certain length of time, a pulse will shut phase A off; turn phase B on, to cycle the motor through 30 degrees in 26 microseconds; as phase B turns on, A shuts off: and so on. Accordingly, if phase C is turned on, phase B in the cycle will be turned off. These cycles will continue very rapidly. In this way, the required RPMs of the rotating arm are met. It follows that a digital signal is generated off the microprocessor 48 with pulse-width modulation: as opposed to the operation of an AC induction motor, which constantly has power on it.

Some other advantages of the motor 6 as provided in the present invention are (a) it can work with different power requirements worldwide so that it operates the whole mechanism internationally; (b) it has requirements for a third less power in operation; only one phase at a time is called for, on the pulse-width modulated signal; (c) less heat is generated since the power requirements of the inventions are less than conventional power units; (d) less operating noise is generated by the invention; any noise generated is an electronic noise which (as opposed to non-absorbent material induction motor 6 which will give off an irrepressible 60 or 120 cycle hum) can be filtered out with an RC networks or some other filtering circuit to make the motor 6 electrically quiet. With a DC brushless, three-phase motor 6, it is possible to filter noise out because there is no vibration of the wires, as it is using DC signals which give off only a very high frequency in the region of 4 kHz. Such a high frequency noise can readily be filtered out with a capacitor and a resistor: in consequence, FCC requirements will be met; (e) a magnetic core replaces a winding, which is cylindrical, is coated and contained in a protective plastic; (f) the transformer cap for the rotary transformer is designed in such a way as to transfer any heat generated by the transformer to be dissipated over the fins located to he top of the cap.

Due to the high speed of rotation at the drive shaft 12 of the motor 6 of 2450 rpm a "stationary" or "still" image with an image repetition rate of about 50 Hz is generated for the person viewing the display device. Depending on the predetermined and programmed memory content that image can be still or moving script comprising alphanumeric characters and also graphic images. It will be appreciated that combinations of such characters and images are also possible.

In order to achieve a greater reading angle for the person viewing the display device, the LED-heads of the array 32 can be beveled, with the beveling preferably being perpendicular to the vertical. In addition it is alternatively possible to use SMD-LEDs.

The flexible (elastically deflectable) leaf spring 38 is fixed to the side of the circuit board 20, opposite the LED array 32. The weight 36 is disposed at the free end of the leaf spring 38 and is vertically displaceable under the effects of centrifugal force to provide for optimum weight equalization to balance the structure about axis 8.

At the beginning of the rotary movement of the arrangement about the axis of the rotation the sagging leaf spring by virtue of the increasing centrifugal force, moves toward a horizontal orientation to stabilize and weight compensate the device during operation.

The display globe 34 is preferably about 30 cm in diameter and has a receiving opening through which the above described arrangement is introduced into the display globe 34. However, larger globes are contemplated.

Because the motor 6 is powered by a completely separate circuit and control from the PCB 30, i.e. there is no direct connection from the motor 6 to the PCB 30 to facilitate a cooperative change in the LED sequence. Hence the PCB 30 must itself measure the speed at which it is rotating. This is accomplished in the present invention by means of the tick indicator 42.

There are 3 functions of the present invention which must be carried out independently from one another for the integrity and dynamic feasibility of the display device. Firstly, as discussed above power must be provided to the motor 6 in order to rotate the shaft 12, PCB 30 and LED array 32 at the necessary speed. Secondly, independent of the power supply to the motor 6, constant and consistent power must be provided to power the PCB 30. Thirdly, data used by LED array 32 controlling the CPU CPU ROT_ processor on the PCB 30 to display the desired text or graphics must be consistently transmitted to the PCB 30. The second and third functions of the device are carried out in the present invention by contactless energy and data transmission respectively to alleviate problems caused by contacting, brushing or slipping parts, a further discussion of both are provided below.

The induction law is implemented for contactless transmission of electrical energy to the PCB 30. This involves making use of the fact that a voltage is generated (induced) in an electrical conductor when the magnetic flux through a surface embraced by that electrical conductor changes in respect of time. As a result a current flows upon closure of the circuit without a voltage source being present in the circuit. Voltage generation is effected under certain necessary conditions in accordance with the law:

when the electrical conductor is so moved in a magnetic field that it cuts the magnetic field lines:

when the electrical conductor is held fast and the magnet is moved:

when the electrical conductor and the magnet are held fast but the magnetic field is changed:

when the electrical conductor and the magnet are at rest and with a fixed magnetic field a substance with a different relative permeability is introduced into the magnetic field: or when the electrical conductor is deformed.

In all the above-depicted situations voltage induction is therefore effected by a change in respect of time in the magnetic flux.

In order to provide power to the LED's and other components on the PCB 30 and to control the text and graphics displayed by the device, and to ensure the longevity of the device, it is desirable to use a contactless power transformer.

As described, there is provided a contactless rotary transformer 18. The rotary transformer 18 has a stator 22 having a primary winding 50 and a rotor 20 having a secondary winding 52 in conjunction with a ferrite magnet 54 for inducing an electrical potential. The secondary winding 52, which is attached to the drive shaft 12. The windings 50, 52 and bobbins 20 are nested concentric windings housed within the ferrite magnet housing 24 which comprises two half shells arranged with their free ends spaced apart thereby forming an air gap between them. Connected with the ends of the turns of the primary winding 50 is an electrical connection cable 56 to supply electrical power from a circuit board power supply 58 while the ends of the secondary winding 52 are electrically connected through the heat sink 26 by an secondary electrical connection cable 60 to supply electrical power to the PCB 30.

The rotation of the secondary winding within the energized primary winding induces a magnetic flux in the secondary winding which in turn generates current in the secondary cable 60. The transformer operates in the same manner as any traditional transformer and may step down the power just as in a traditional transformer. The secondary cable 60 provides power to the PCB 30 without any need for any physical contact between structural parts whatsoever.

It is important that the drive shaft 12 be a hollow tube. The drive shaft 12 thus defines a longitudinal through bore, or in other words a light pipe, along axis 8 extending between a first and second ends of the drive shaft 12 through which data transmission to the rotating PCB 30 can be made.

The hollow drive shaft 12 has the first end vertically supported on the thrust bearing 16 and laterally supported by bearings 14 spaced along the shaft 12 and is driven by the motor 6 as set forth above. The drive shaft 12 extends upwardly from the base housing and supports the inner bobbin 20 and secondary winding 52 which, as previously discussed, provides power to the PCB 30 and LED array 32 mounted at the upper end of the drive shaft 12. Finally, the upper end of the drive shaft 12 supports the PCB 30 and its components, arm 44 and LED array 32.

On the rotating PCB board 30, an infrared receiver 62 is located on a bottom surface thereof on axis 8 and a CPU ROT processor 400 is also supported on the rotating board 30. The infrared receiver is thereby located to receive infrared data through the shaft 12 along the axis 8 and has a direct line of sight all the way to the lower end of the shaft 12. This prevents room light or other interfering lighting or objects interfering with a data signal to be received by the infrared receiver 62. This feature relates only to the transmission of data. A data entry unit, or BASE processor 300, to be discussed in further detail below, accepts in general, infrared keyboard RS232 data, RS45 data network data, and any other necessary data to facilitate as many ways as possible of communicating with PCB 30. This is independent of any electrical connection to the drive motor or the power generator for the PCB 30. Being totally independent, the separate power system allows greater accuracy for the transmission of data to the PCB 30.

Located in the base of the structure 2 at the lower end of the shaft 12 is an infrared data transmitter 66 positioned to transmit data from the data entry unit, or BASE processor 300 through the tubular shaft 12 to the infrared receiver 62. This data is then sent by cable 70 to the CPU ROT processor 400 of the PCB 30 to control the operation of the LED array 32 to produce a desired alphanumeric and/or graphical display with timing inferenced by the tick indicator 42.

As to the transmission of data to the LED array 32, there is a dynamic memory access controller 72 on the CPU ROT processor 400 which handles data movement between the infrared processor and the PCB 30. Data movement operations as controlled by the CPU ROT processor 400 provide output display data from the memory of the microprocessor to control operation of the LED array 32.

Figure 2:
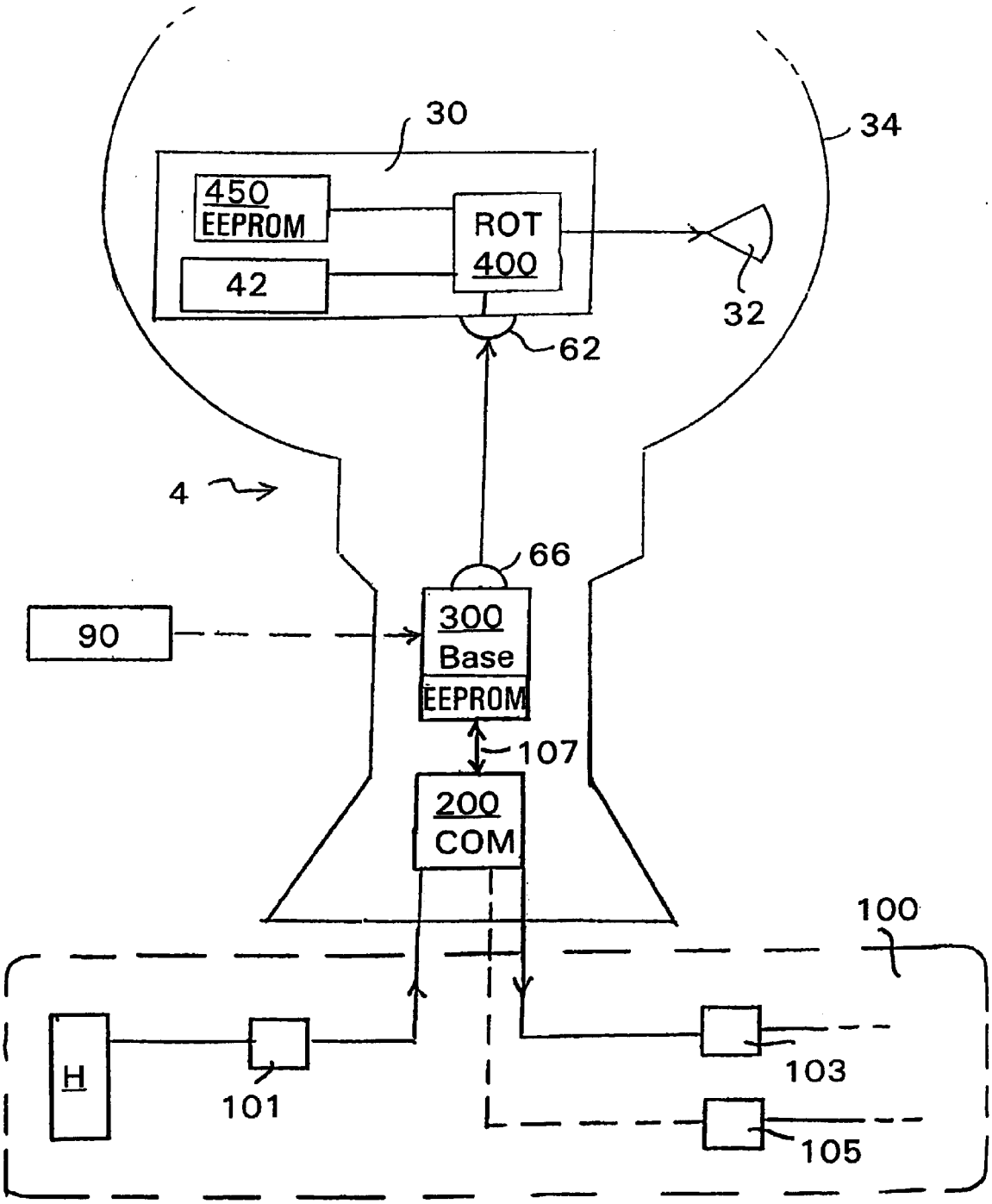
FIG. 2 is a high level network and apparatus block diagram.

FIG. 2 is a high level diagram of the data movement operations in cooperation with a local area network 100 to allow multiple linked together devices to be controlled via a connection to a host computer H. The network 100 itself consists of the host computer H communicating with any number of nodes, i.e. display devices 4. The nodes can be connected for example in a tree structure with the host H at the root of the tree. Each node is provided with one upstream port 101 and one downstream port 103 which may control one or more display devices 4. The upstream port 101 remains connected to the host H, or a downstream port of another node. As other network configurations may also be used as are known by those of skill in the art no further discussion is provide.

The display device 4 may be part of the network 100 of other similar linked devices and computers, for example data can be input either locally to the display device 4 via the IR keyboard 90 communicating with the BASE processor 300 or data may also be input via the upstream network terminal 101 with data flowing downstream via the downstream network terminal 103 to other linked devices and computers. No matter where the data originates, the communication (COM) processor 200, generally located in the base 2 of the display device 4, handles all the network data traffic.

Both the upstream and downstream network connections or ports 101,103 respectively are ordinary point to point RS-232 connections. The upstream port 101 is either connected to the host H or the downstream port of an adjacent node. The downstream port 103 is either left unconnected or is connected to the upstream port of another node. This allows a chain of nodes to be connected to a single host serial port (COM port on PCs).

The network protocol and host software are designed to support nodes having at least a second downstream port 105. This is intended to support "hub" nodes to allow the network topology to be a full tree instead of a linear chain. The network protocol consists of layers where each layer adds logic to implement its own specific features using only the features provided by the next lowest layer, the layers are described in detail below.

In a Physical Transport Layer, the port connections are implemented using 3-wire (TX, RX, and GND) RS-232 at 115.2K baud, 1 stop bit, 8 data bits, no parity. In a Flow Control Layer, the XON/XOFF flow control method is used. In an Escape Sequence Layer the flow control layer allows sending and receiving of only 254 out of the possible 256 byte codes because the XON and XOFF byte codes are used for flow control. The purpose of this layer is to send and receive arbitrary byte streams (all 256 possible byte codes) using the 254 byte codes available via the flow control layer. Byte codes that can not be sent directly are wrapped in an "escape sequence" consisting of two bytes, the ESC character (1Bh), and a modified data byte. Data is passed over the network in packets. A Packet Layer is provided to ensure reliable and verifiable transport of commands from the host to the nodes. All communication on the network is wrapped in packets, namely upstream packets and downstream packets. The format of the packets differ for each of the data directions.

Downstream packets are sent form the host H, or from a node to one of more of the network downstream ports. Upstream packets are originated by nodes and sent to the next upstream node, i.e. passed from a downstream port to the adjacent upstream port.

Most packets are either passed between the upstream and downstream ports 101, 103 or acted upon locally in the COM processor 200. If a packet containing data for control and operation of the device 4 itself (as opposed to network management data or data for other nodes) is received, it is unwrapped from its packet in the COM processor 200 and passed as raw data to the BASE processor 300 via an IIC (Inter Integrated Circuit) bus 107.

The BASE processor 300 can receive data bytes via the network 100 and the COM processor 200, or directly from the IR keyboard 90. Some commands are acted upon locally in the BASE processor 300, but most bytes are sent to the rotary (ROT) processor 400 via the infrared transmitter 66 and receiver 62, i.e. a light pipe, for eventual visual output by the LED's 32. The BASE firmware runs the BASE commands on a Microchip PIC 16F876 processor in the BASE processor 300. It receives the following inputs:

1) IR keyboard bit stream. This comes from the keyboard receiver and demodulator. This is a low level when the keyboard carrier is detected, and high when not.
2) RS-232 input. This is only used in stand along configuration and is ignored in networked configuration.
3) A bit tied to the COM processor that is pulled low when in the networked (not stand along) configuration. This line is pulled high by a weak pull up in the BASE processor when the COM processor is not present. The presence of the COM processor determines networked versus stand along configuration.
4) In the network configuration, the IIC bus 107 is used to communicate with the COM processor 200 on the same board. The BAS processor 300 responds with the device name string when queried, and otherwise accepts a command input stream that is merged with the stream from the IR keyboard.

The BASE processor 300 produces the following outputs:

1) Serial bit stream for the PCB 30. This bit stream is RS-232 timing at 1200 baud, and is transmitted to the display board via the infrared LED 66.
2) RS-232 output in stand alone configuration. The device's RS-232 port is controlled by the COM processor in network configuration.

The purpose of the BASE firmware is to interpret the IR keyboard input stream, the RS-232 input stream in stand alone configuration, the IIC bus command stream in networked configuration, and send information to the PCB 30 as appropriate. In some cases, information is returned over the IIC bus 107 to the COM processor 200.

The input byte stream from the IR keyboard 90, the IIC bus 107 if networked, and the RS-232 port if stand alone are merged byte by byte to become one command stream. Only certain bytes are interpreted as command codes. All other bytes are passed directly to the ROT processor 400 which interprets additional commands. Except for the codes explicitly listed below, codes 0–31 are interpreted as commands by the ROT processor 400 or are reserved for future commands. Codes 32–255 are message characters.

The rotary PCB 30 carrying the ROT processor 400, as the name implies, is spinning with respect to the base 4. As previously discussed, the rotary PCB 30 receives power via the transformer 18 that has its secondary winding spinning on the shaft 12 as previously described. This same shaft 12 is hollow, and is used as a data conduit or light pipe to send data from the BASE processor 300 to the rotary board 30. The light data is transmitted by the stationary IR LED 66 located in the base and aligned with the bottom of the shaft 12 and is received by an IR phototransistor 62 on the rotary board 30 at the top of the shaft 12. The light pipe protocol is RS-232 at 1200 baud, so it can be transmitted and received by the ordinary UARTs built into the BASE and ROT processors 300 and 400 respectively.

The ROT processor 400 interprets bytes 0–31 as commands and 32–255 as message characters. The ROT firmware runs on a Microchip PIC 16C66 processor on the rotating board and receives the following inputs:

1) A short pulse when the arm passes a particular point every rotation.
2) A serial bit stream via the light pipe from the LED 66 mounted in the base. This uses the RS-232 protocol.

The process produces the following outputs.

1) It can separately light or not light the LED pixels arranged vertically on the horizontally rotating arm. Horizontal pixels are achieved by changing the values written to the vertical pixels as the arm sweeps around its arc.

The ROT firmware assigns memory addresses, i.e. a horizontal and vertical grid arrangement of pixels around the 360 degree arc of the arm. A memory address counter is also provided which counts, or keeps track of the addresses through which the arm passes during the 360 degree arc based upon the tick indicator. For example, assuming that there are 360 horizontal pixels or addresses, although any number is possible, as the tick indicator 42 indicates to the ROT processor that the arm has passed the bar 44, the ROT processor, namely the address counter, calculates the speed of the arm for one revolution (1 rev time) and divides the 1 rev time by 360 horizontal pixels to thus recognize at any given point in time where, i.e. at what horizontal memory address, the arm is located about the 360 degree viewing periphery, and can light, or not light the appropriate LED's for each specific horizontal memory address according to the supplied data.

The address counter can thus synchronize a shifting address, incrementing or decrementing an LED on, or LED off occurrence from for instance a zero starting position, to provide a steady visual display or a moving visual display.

The shift address allows, for example, scrolling of images in a right or left direction or even in a vertical up and down direction or essentially any conceivable 2 dimensional direction.

The purpose of the ROT firmware is to display a message on the cylinder swept by the LEDs as the arm spins. The message can be modified via the serial interface. The firmware is either in display mode or edit mode. In display mode, the message is displayed normally. It can be scrolled left or right at an adjustable rate. In edit mode, the end of the message is displayed following by a cursor. The edit mode message is stationary, regardless of the scroll rate setting. New characters can be added to or deleted from the end of the message.

Specifications may include: Number of characters around the ball: 25, Serial protocol: RS-232 at 1200 baud, 1 stop bit, no parity, no flow control, maximum message length: 4000 characters, Pixels: Standard upper case letters are displayed 13 pixels tall, 9 pixels wide. An additional three rows of pixels below this is used for descenders.

The message and configuration information are saved in non-volatile memory such that they are preserved when power is removed and re-applied. The message characters are kept in an EEPROM 450 that is external to the ROT processor. This provides non-volatile storage for the message and message parameters, like scroll rate and orientation.

The ROT processor 400 is also responsible for providing a timing cycle for lighting the appropriate LED's in order to provide the visual output. In order to provide the necessary accuracy, the tick indicator 42 supplies a positioning signal to the ROT processor 400 whenever the rotary arm passes that specific position. The ROT processor 400 is therefore able to determine its exact position within a 360 degree rotation based on rotational speed and thus accurately determine where the arm is at all times and actuate the appropriate LEDs accordingly.

Figure 3:
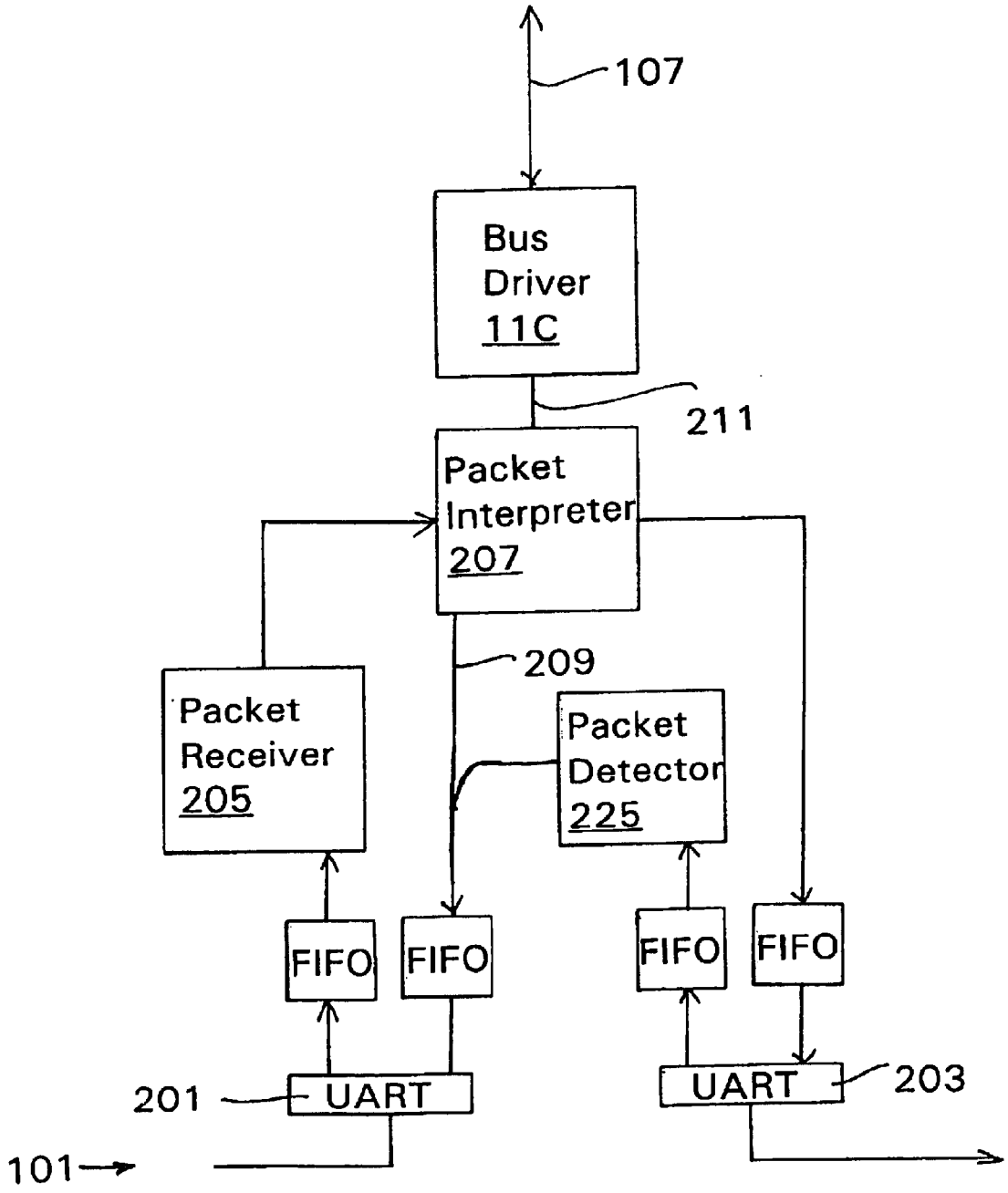
FIG. 3 shows a Communication (COM) Processor block diagram.

Turning to FIG. 3 a description of the COM Firmware Block Diagram is provided below. The COM firmware runs on a Microchip PIC 17C752 processor on the base board. It has the following inputs and outputs:

1) RS-232 upstream port 101. Upstream is toward the host computer as discussed above.

2) RS-232 downstream port 103. Downstream is away from the host computer.

3) IIC bus port 107. This bus is local to the device BASE processor 300. The only other device on this bus is the BASE processor that handles the IR keyboard input and light pipe output to the rotating board. This processor also has a small amount of internal EEPROM where all the network configuration state is kept.

Specifications include: RS-232 Hardware Protocol. Both RS-232 ports use 115.2K baud, 8 data bits, 1 stop bit, no parity, and XON/XOFF flow control. The network topology and protocol is described above.

The protocol used on the IIC bus local to the device base board. The following devices are connected to this bus:

1) The COM processor running the COM firmware. This processor also handles the network connections.

2) The BASE processor 300 running the BASE firmware. This processor is also connected to the IR keyboard input, the light pipe to the rotating board, and contains the non-volatile memory where the network configuration state is kept.

The COM processor 200 starts out as the bus master and the BASE processor 300 as the slave. The COM processor waits 200 mS during system initialization before attempting to use the IIC bus 107. During system initialization, the COM processor performs one IIC read sequence to get the device name string. the BASE processor responds with a length byte followed by the name string. The COM processor reads the length byte, then uses that to read exactly the number of bytes in the name string.

After the name string is transferred form the BASE processor to the COM, the BASE becomes the IIC bus master and COM the slave. The BASE disables its IIC hardware and waits 200 mS before becoming the IIC bus master. The BASE then starts a single IIC bus read sequence. Each byte transferred is then merged into the command input stream in the BASE. This IIC bus read sequence is not terminated until power down.

All packets from the upstream port 101 must be received and checked for validity. The first byte of a downstream packet (a packet that flows downstream, and is therefore received by the upstream port 101), determines whether the packet must be forwarded to the downstream port or not. To avoid store and forward delays, this is done as the packet bytes are received and not after the whole packet is received.

After being received at the upstream 101 port and passing through a FIFO buffer, a packet receiver 105 checks each packet for validity based on its checksum and other criteria and passes the packet on to a packet interpreter 107. If the packet is valid, it is examined by the packet interpreter 107 for the action required by this node. There are several possible actions which could be undertaken with a packet within the COM processor 200. (1) A downstream packet may require an upstream packet be sent as a response (for example, a command received validation message) by passing the response as an upstream packet along path 109 to be returned to the host via another FIFO buffer and the upstream port 101. (2) A downstream packet may be sent directly to the downstream port 103 along path 113 and continue through the network for further action at a subsequent node or device. (3) A valid data packet and/or data bytes for control of the apparatus is passed along path 111 and sent to the BASE processor via the IIC bus. The COM processor is also responsible for detecting an upstream packet at the downstream node 121 via a packet detector 125 and passing the upstream packet to the upstream node 101 for continuance upstream in the network 100.

All the complexity of the network communications is encapsulated in the COM processor 200. The BASE Processor 300 thus receives a stream of raw validated data bytes with no extraneous baggage data or knowledge of how the data were transmitted on the network 100.

Figure 4:
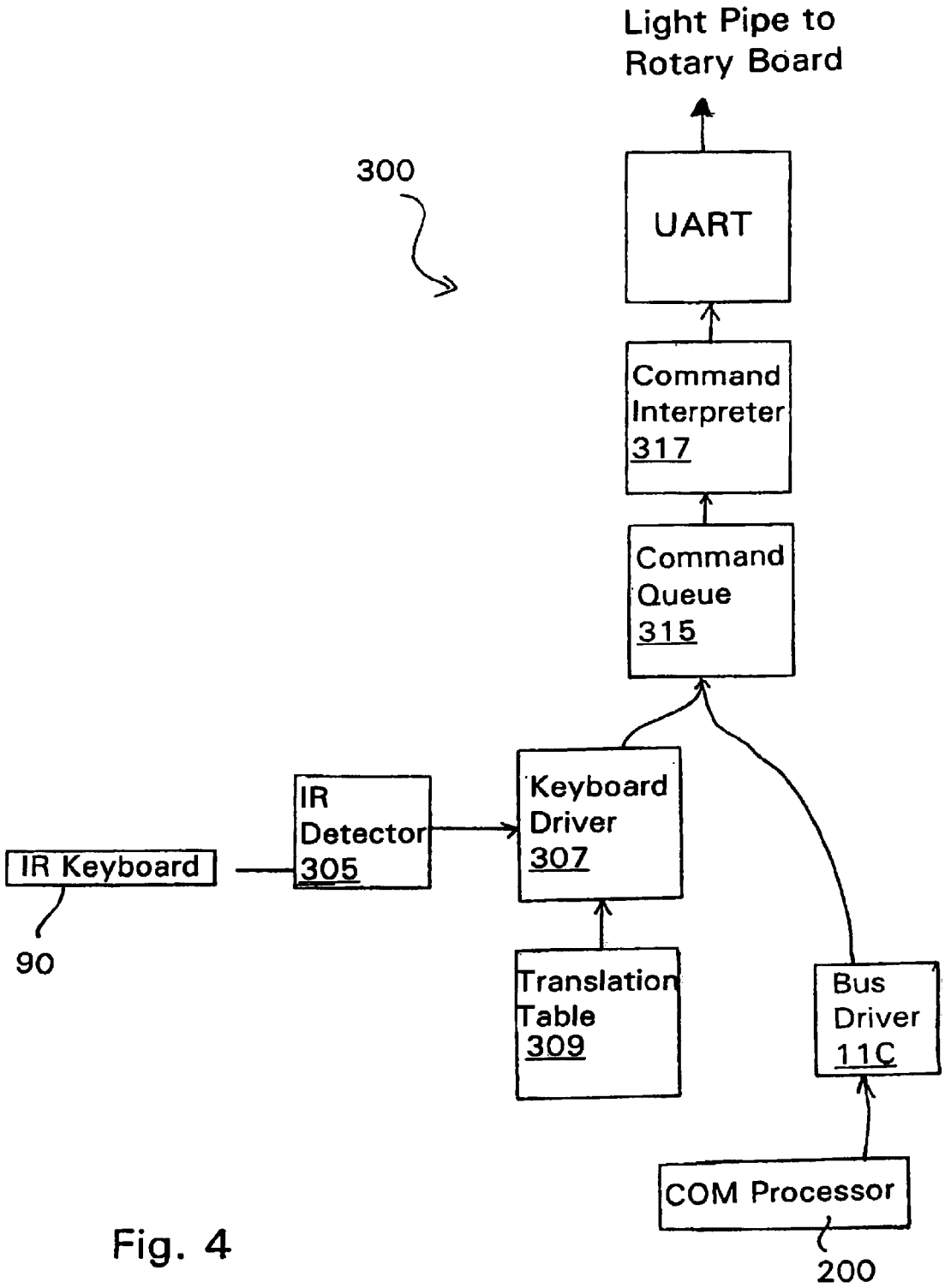
FIG. 4 details a stationary Base (BASE) Processor block diagram.

FIG. 4 discloses a BASE Firmware Block Diagram having the BASE processor 300 receives commands from two sources and merges them into one command stream that it the acts upon. Commands can come from (1) the COM processor 200 via the IIC bus or (2) the IR keyboard 90.

The IR keyboard 90 sends key codes (not ASCII characters) using a private protocol of IR carrier pulses. Individual pulses are received by an IR detector 305 using pulse capture hardware built into the BASE processor 300, which allows easy measurement of the time between pulses. This pulse train is decoded into key codes by the keyboard driver 307. The key codes are further translated to normal character codes using a keyboard translation table 309. This table is kept in the BASE processors program memory, which is implemented as FLASH. The translation table 309 can be uploaded to support different keyboards, such as U.S. English, U.K. English, German, Spanish, etc.

The characters resulting from the IR keyboard 90 and those coming from the COM processor 200 are merged into one command stream and queued in a command queue 315 for presentation to a command interpreter 317. Some of the bytes of this stream are interpreted as commands locally, while most of them are simply passed on to the ROT processor 400 via the light pipe.

Figure 5:
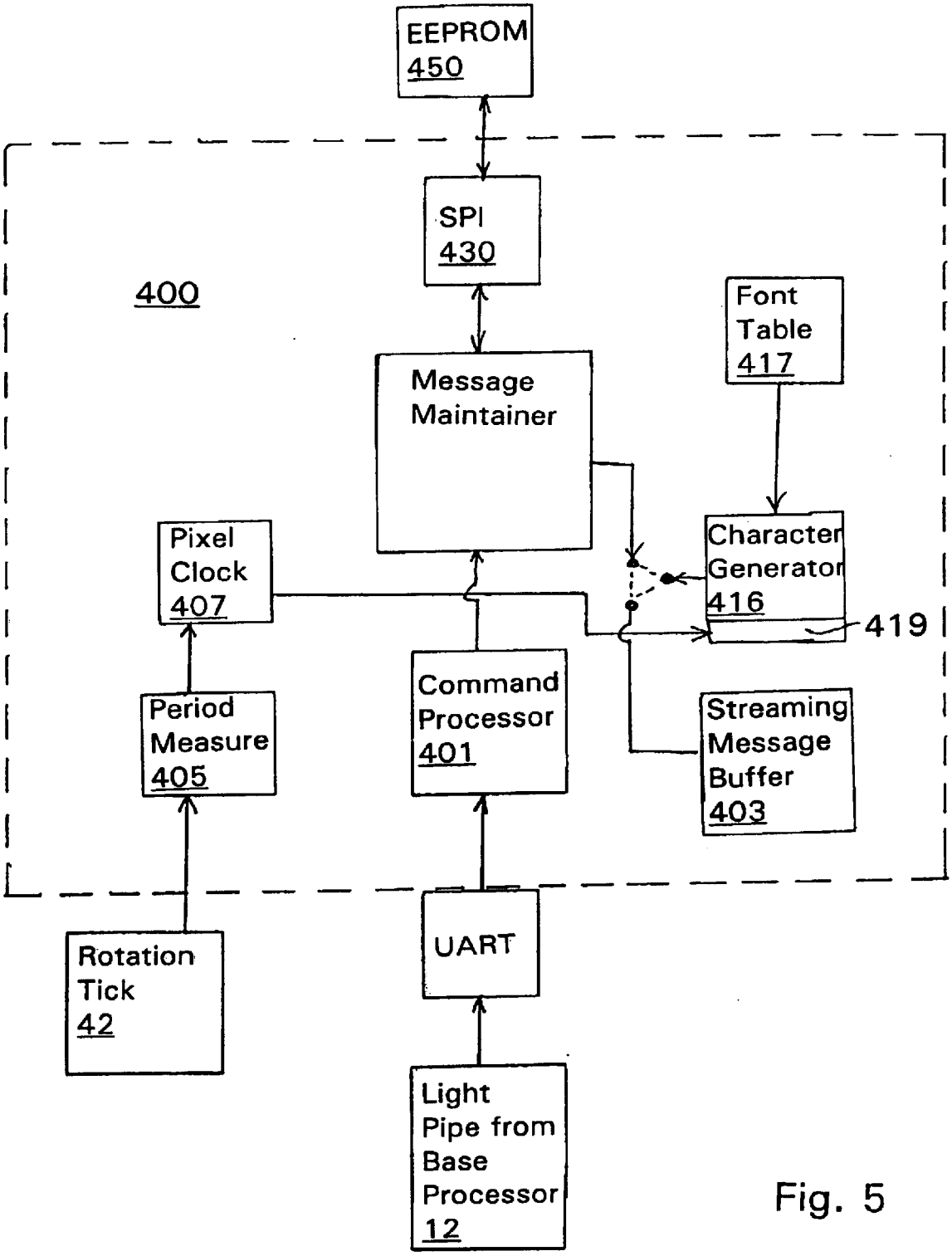
FIG. 5 shows a rotating (ROT) Processor block diagram.

Turning now to the ROT Firmware Block Diagram as shown in FIG. 5, the ROT processor 400 is located physically on the rotating PCB 30 and receives a command data stream from the BASE processor 300 via IR light pulses communicated through the light pipe. As previously discussed the ROT processor 400 also receives a locating signal whenever the rotating arm passes through the specific tick indicator 42.

Bytes values 0–31 are interpreted as commands, and values 32–255 as message characters. The message can be up to 4000 characters long, and is stored in a separate EEPROM 450. The processor 400 communicates with the EEPROM 450 via an SPI bus, using SPI hardware built into the ROT processor 400.

In streaming message mode, message characters are written to a special buffer 403 instead of used to update the stored message. A servo algorithm automatically adjusts the message scroll rate to match the average incoming character rate. In the long run, the servo algorithm attempts to keep the buffer 403 half full. The servo response is smooth enough so that short bursts or gaps in the character flow can be tolerated without causing a noticeable change in the scroll rate to a human observer.

The rotation tick 42 is received by special hardware in the ROT processor 400 that captures a free running timer value at each pulse. These captured values are used to determine the period measure 405 of rotation time to a very high accuracy. These values are eventually used to generate an assumed position of the rotary arm at any time via a pixel clock 407 generate an internal clock signal for each pixel as the arm sweeps around its arc.

The character generator 415 maintains a small buffer 419 in RAM that is slightly larger than the number of characters displayed on the Device in one revolution of the arm. It uses the pixel clock 407 to sequence through the horizontal pixels of a character and to sequence through the characters in the buffer. The font table 417 provides the translation of a character code to the pixels of its bitmap image. The small display buffer 419 is updated based on the message scroll rate. New characters are received form the stored message in normal mode, or from the streaming message buffer in streaming message mode.

Figure 6:
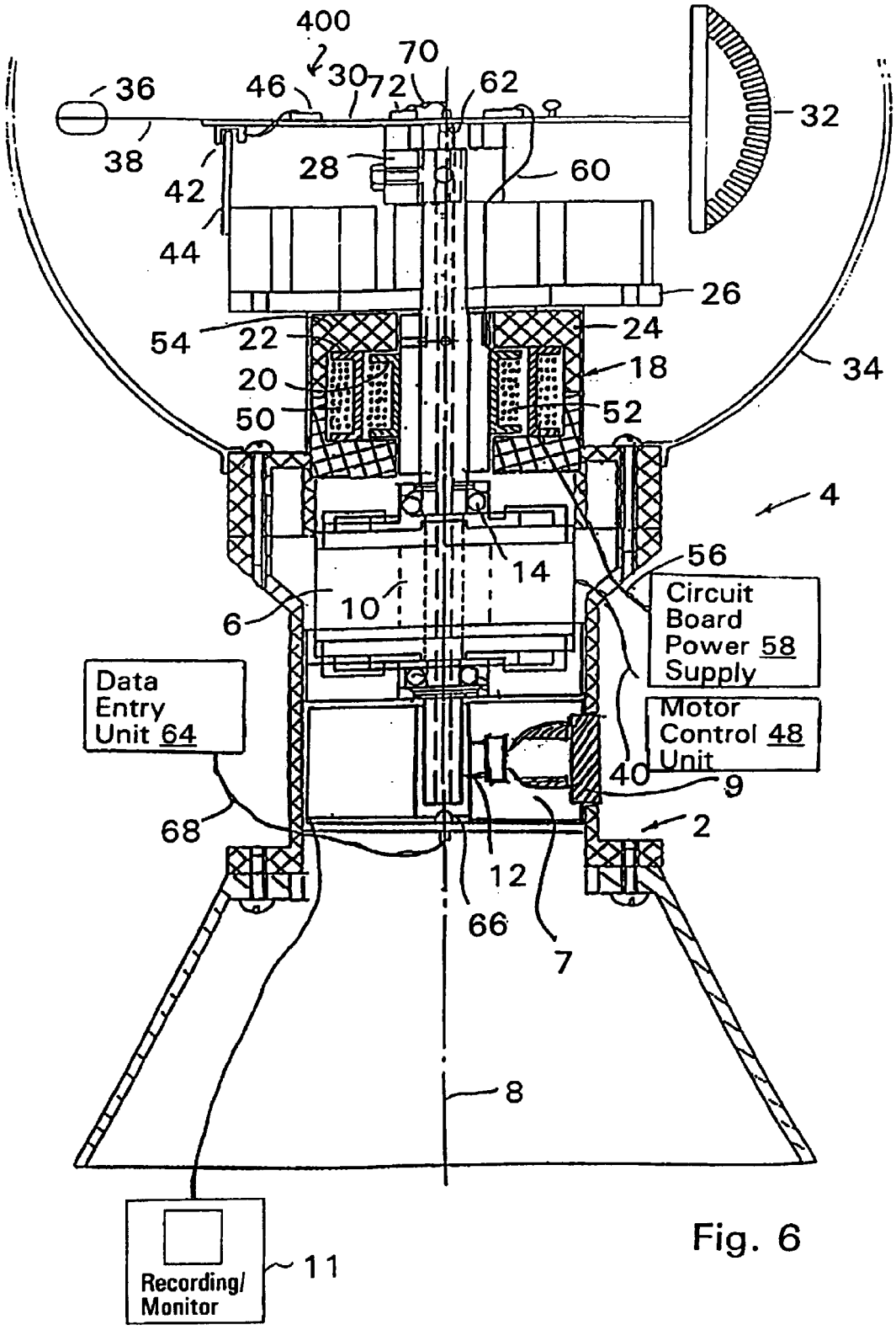
FIG. 6 is a sectional view of the display device incorporating a camera or video scanner or like device in the base.

A further embodiment of the present device as shown in FIG. 6 incorporates one or more cameras or video scanners 7 or analogous area monitoring devices into the base 2 of the device 4. These devices which are known in the art are useful for imaging or sensing the environment surrounding the device 4 and can be unobtrusively incorporated into the structural design of the device 4 particularly in the base 2 as shown without interfering with the electronics and mechanics of the device 4. A plurality of cameras or video scanners 7, each having a desired viewing angle through a lens 9 disposed around the circumference of the base 2 can monitor all or a portion of a 360 degree view around the device. The cameras or video scanners 7 are connected to a video monitor or recording device 11 which can allow visual monitoring of the environment surrounding the device 4. As the use and function of such monitoring devices for security, safety or other purpose is well known in the art, no further discussion is provided.

Without departing from the spirit and scope of the invention herein involved, it is intended that all of the subject matter of the above description or shown in the accompanying drawings shall be interpreted merely as examples illustrating the inventive concept herein and shall not be construed as limiting the invention.

What is claimed is:

1. A local area network comprising:

a host computer communicating with a moving display device having a vertically oriented LED array for projecting a moving display onto a translucent surface;

display control data;

network control data;

at least one of the display control data and network control data is supplied by the host computer to a stationary communication processor in the display device and the display control data is relayed via infrared data transmission from the stationary communications processor to a rotating display processor for controlling the LED array;

the display device further comprises non-contact power transmission to the rotating display processor via magnetic induction, the display control data is relayed via infrared data transmission along a line of sight between an infrared transmitter positioned on the stationary communications processor and an infrared receiver connected to the rotating display processor, and wherein the line of sight is provided along the axis of a hollow drive shaft rotatably supporting the rotating display processor within the display device and the hollow drive shaft rotatably supporting the rotating display processor within the display device is driven by a motor, and a first power supply for the motor, a second power supply for the stationary communication processor and a third power supply for the rotating display processor and LED array are independent of one another.

2. The local area network as set forth in claim 1 further comprising a remote data entry device for directly providing via infrared data transmission of at least one of the display control data and network control data to the stationary communication processor in the display device.

3. The local area network as set forth in claim 2 further comprising a plurality of networked display devices wherein the display and network data is selectively passed between the host computer and the plurality of connected display devices.

4. The local area network as set forth in claim 1 wherein the display device is provided with a video camera connected to a video monitor device for visually monitoring a desired area around the display device.

5. A local area network comprising:

a host computer communicating with a moving display device having a vertically oriented LED array for projecting a moving display onto a translucent surface;

display control data;

network control data;

at least one of the display control data and network control data is supplied by the host computer to a stationary communication processor in the display device and the display control data is relayed via infrared data transmission from the stationary communications processor to a rotating display processor for controlling the LED array;

the display device further comprises non-contact power transmission to the rotating display processor via magnetic induction, the display control data is relayed via infrared data transmission along a line of sight between an infrared transmitter connected to the stationary communications processor and an infrared receiver connected to the rotating display processor, and wherein the line of sight is provided along an axis of a hollow drive shaft rotatably supporting the rotating display processor within the display device.

6. The local area network as set forth in claim 5 wherein the hollow drive shaft rotatably supporting the rotating display processor within the display device is driven by a motor, and a first power supply for the motor, a second power supply for the stationary communication processor and a third power supply for the rotating display processor and LED array are independent of one another.

7. A local area network comprising:

a host computer communicating with a moving display device having a vertically oriented LED array for projecting a moving display onto a translucent surface;

display control data;

network control data;

at least one of the display control data and network control data is supplied by the host computer to a stationary communication processor in the display device and the display control data is relayed via infrared data transmission from the stationary communications processor to a rotating display processor for controlling the LED array;

the display device further comprises non-contact power transmission to the rotating display processor via magnetic induction, the display control data is relayed via infrared data transmission along an unobstructed line of sight between an infrared transmitter connected to the stationary communications processor and an infrared receiver connected to the rotating display processor, and wherein the unobstructed line of sight is provided along an axis of a hollow drive shaft rotatably supporting the rotating display processor within the display device.

* * * * *